United States Patent [19]

Moore et al.

[11] 4,427,519

[45] Jan. 24, 1984

[54] MERCURY CATHODE ELECTROLYTIC CELL HAVING PROTECTIVE SHIELD

[75] Inventors: Charles L. Moore; Dennis J. Odom, both of Cleveland, Tenn.

[73] Assignee: Olin Corporation, New Haven, Conn.

[21] Appl. No.: 313,419

[22] Filed: Oct. 21, 1981

[51] Int. Cl.[3] ..... C25B 1/40; C25B 9/00

[52] U.S. Cl. ..... 204/219; 204/250; 204/279

[58] Field of Search ..... 204/219–220, 204/250, 279; 266/903; 241/37.5; 74/612–615, 608; 51/269; 220/324–325, 328, 89 A, 85 R

[56] References Cited

U.S. PATENT DOCUMENTS

| | | | |
|---|---|---|---|
| 2,627,501 | 2/1953 | Gardiner | 204/250 X |
| 3,198,722 | 8/1965 | Callahan | 204/219 |
| 4,043,701 | 8/1977 | Jaeger | 51/269 X |
| 4,054,064 | 10/1977 | Walker | 74/612 |
| 4,245,566 | 1/1981 | Shimansky et al. | 220/89 A X |

*Primary Examiner*—Donald R. Valentine

*Attorney, Agent, or Firm*—Ralph D'Alessandro; Donald F. Clements; Thomas P. O'Day

[57] ABSTRACT

A protective shield adjacent the electrolyzer container and electrolyzer cover for a flowing mercury chlor-alkali electrolytic cell is provided to serve as a stop to prevent retaining means utilized to hold the electrolyzer cover in position from being propelled into the work area and hot brine from being spewn into the work area in the event of explosive hydrogen gas buildup within the electrolytic cell gas.

5 Claims, 3 Drawing Figures

MERCURY CATHODE ELECTROLYTIC CELL HAVING PROTECTIVE SHIELD

BACKGROUND OF THE INVENTION

The present invention relates generally to chlor-alkali electrolytic cells employing flowing mercury as the cathode. More specifically, the present invention relates to a protective shield that is placed adjacent the electrolyzer cover to prevent the retainers which fasten the cover to the cell from being propelled at high speed across the cell building area in the event that hydrogen gas buildup within the cell gas rises to an explosive state. The protective shield also prevents hot brine from being expelled from the electrolytic mercury cell container onto the work area where operators may be in the event of an explosion.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chlor-alkali cells. The chlor-alkali cells are of two general types, the deposited asbestos diaphragm-type of electrolytic cell or the flowing mercury cathode-type of electrolytic cell. In the mercury cells, the brine is electrolyzed between anodes of a particular composition and the flowing mercury cathode. Chlorine is liberated at the anodes and sodium amalgam is formed at the cathode. In a subsequent step, caustic soda and hydrogen are produced from this amalgam in a separate decomposer compartment. Because of this two-step operation, mercury cells are able to produce without further treatment an unusually pure grade of 50% caustic that has exceptionally low sodium chloride content. Frequently, because of this low salt content, the mercury cell caustic does not require further purification prior to industrial use. Thus, the caustic, as well as the amalgam and the chlorine, produced from mercury cells are still economically attractive products.

There have been numerous advances in the mercury cell technology, such as the computer adjustment of anodes during operation to optimize efficiency of cell operation. However, because of the nature of the operation of mercury cells, the percentage of hydrogen in the cell gas continues to be a troublesome controlling factor in mercury cell operation. A mixture containing more than 5% hydrogen in chlorine is explosive if exposed to sunlight or an electrical discharge. The concentration of hydrogen in chlorine is normally about 0.2 to 0.5 percent. The release of energy from an explosion caused by hydrogen buildup above the acceptable level, often as low as 1 to 3 percent by volume, can cause the cell or electrolyzer cover to warp or bend, shoot off the C-clamps that hold the cover in place, and cause hot brine to spill over the sides of the cell container onto the operators who are working in the area.

This buildup of hydrogen gas can be caused by a number of different conditions. Impure brine containing magnesium, iron and other polyvalent metals in suspended solids can cause the hydrogen overvoltage on the mercury surface to lower and produce excessive hydrogen discharge during the operation of the cell. A low brine concentration or an inadequate supply of brine can also lead to abnormally rapid formation of hydrogen in the mercury cell. The high sodium concentration in the amalgam, normally anywhere above 0.2 percent, can cause the percentage of hydrogen in the chlorine stream to increase. This is especially true if coupled with other unfavorable operating conditions. Mechanical difficulties in the operation of the cell, such as a stoppage of mercury circulation across the sloped bottom of a mercury cell, the breakage of an anode, or a short circuit to the mercury cathode, can also result in a rapid buildup of hydrogen gas. Should the bottom of the mercury cell or electrolyzer be badly out of level so that the flow of the liquid is disrupted, rapid hydrogen gas buildup will also occur. Similarly, excessive accumulation of impurities in the bottom of the cell will have the same effect. Lastly, the pH of the brine employed can affect hydrogen buildup. It is known that hydrogen formation is markedly accelerated when the pH drops below 1.2.

Other occasions when explosive potential can be realized occur when there is a shutdown of mercury cells. Whenever the current is interrupted, the sodium in the amalgam reacts with water in the electrolyzer cell to form hydrogen, even though no chlorine is produced. If one cell is stopped, it must be immediately vented or, if a plant-wide power failure occurs, emergency power must be provided to maintain suction in the chlorine gas conduits to remove hydrogen from the cell. The start-up of these cells can be particularly hazardous if air is not drawn through the cells prior to start-up after shutdown. Since most commercial mercury cells operate in approximately a 260,000 to 300,000+ ampere operating current range with approximately 4+ volt DC potential, any buildup of hydrogen gas from the aforementioned condition makes explosions a distinct and likely possibility.

These explosions can warp the electrolyzer covers or cell tops, even though they are normally formed from up to $\frac{1}{2}$ inch thick metal. Additionally, C-clamps that hold the covers or tops in place are shot off by the explosive force and can be propelled considerable distances through the cell building. Explosions from localized pockets of hydrogen gas will also cause the hot brine in the electrolytic containers to spill over the sides of the cells, presenting definite safety hazards to operators in the immediate area.

The foregoing problems are solved in the design of the apparatus comprising the present invention.

SUMMARY OF THE INVENTION

It is a principal object of the present invention to provide a safety protective shield that will prevent the C-clamps or retaining means from being shot across the cell work area and from being a hazard to workers in the area.

It is another object of the present invention to provide safety protective shields which prevent hot brine from being spewn out into the work area adjacent the cells where mercury cell operators are located.

It is another object of the present invention to provide a simple and low cost safety feature that will protect operators in the cell area from the hazards of a low level explosion that can be caused by hydrogen gas buildup in the cell gas.

It is a feature of the present invention that the protective shield is fastened to the mercury cell or electrolyzer adjacent the top or cover of the cell.

It is another feature of the present invention that the protective shield is elongate and of sufficient strength to withstand the impact of C-clamps being projected thereinto.

It is an advantage of the present invention that the protective shield is relatively simple and easily connected to the cells.

It is another advantage of the present invention that the protective shield is of low cost.

There and other objects, features, and advantages are obtained in a mercury chlor-alkali electrolytic cell having an electrolyzer container with a plurality of anodes, a flowing mercury cathode, and an electrolyzer cover separated from the container by a gasket and secured thereto by a plurality of retaining means adjacent to which is positioned protective shield means connected to the electrolyzer container such that the flight path of the retaining means and any electrolyte expelled from the container is interrupted when the retainers are forced from their positions and electrolyte is spewn out of the container because of explosive buildup of hydrogen gas within the electrolytic cell gas.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
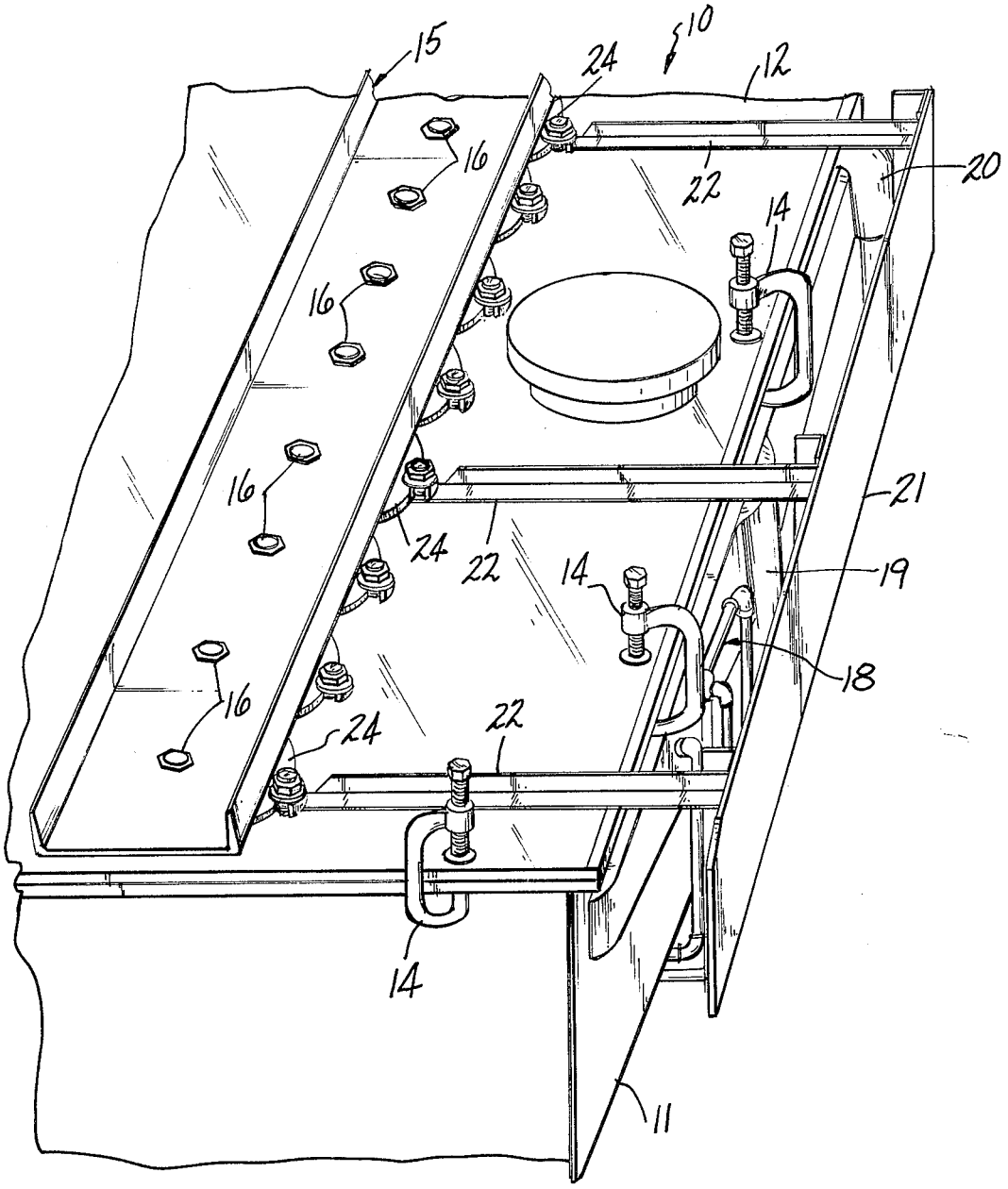
FIG. 1 is a partial perspective view of a mercury chlor-alkali electrolytic cell showing the shield means fastened to the cell.

Referring now to FIG. 1, there is shown in perspective view a portion of a mercury cell or electrolyzer, indicated generally by the numeral 10. Cell 10 comprises a generally rectangular container 11 with an electrolyzer cover 12 attached thereto. The cover 12 is held in place atop of the container 11 via a plurality of retaining means, such as C-clamps 14. Cell 10 has a plurality of anodes that are normally arrayed in sets and are indicated generally by the numeral 15, only one of the two rows comprising each set being shown. Each row has a plurality of anode posts 16 which extend down into the cell.

Also partially shown in FIG. 1 are air lines indicated generally by the numeral 18, which are utilized to operate cell switches to bypass current around the cell when necessary. Also partially shown is inlet brine line 19 that has a rotameter (not shown) therein. Chlorine discharge line 20, partially shown, carries the chlorine gas produced in the cell 10 to the main header. Protective shield means 21 is shown fastened by a plurality of angle iron brackets 22 to the anode seal rings 24.

The mercury electrolytic chlor-alkali cell 10 has been described only generally thus far because its structure and operation are well known to one skilled in the art. A more detailed description of the operation and the structure of the mercury chlor-alkali electrolytic cell is contained in U.S. Pat. No. 3,900,373, issued Aug. 19, 1975, to Richard W. Ralston, Jr. and assigned to the assignee of the present invention. This patent is hereby specifically incorporated by reference insofar as it is consistent with the instant disclosure.

Figure 2:
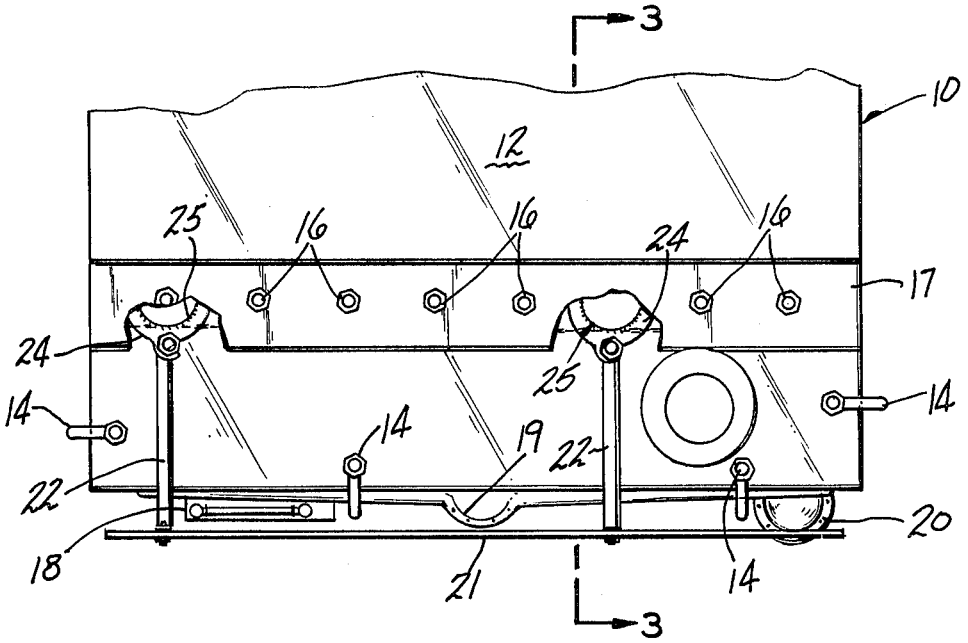
FIG. 2 is a top plan view of a portion of the electrolytic cell with a portion of the bus bar and anodes are broken away showing an alternative number of angle iron brackets that may be used to fasten the shield means to the cell.
Figure 3:
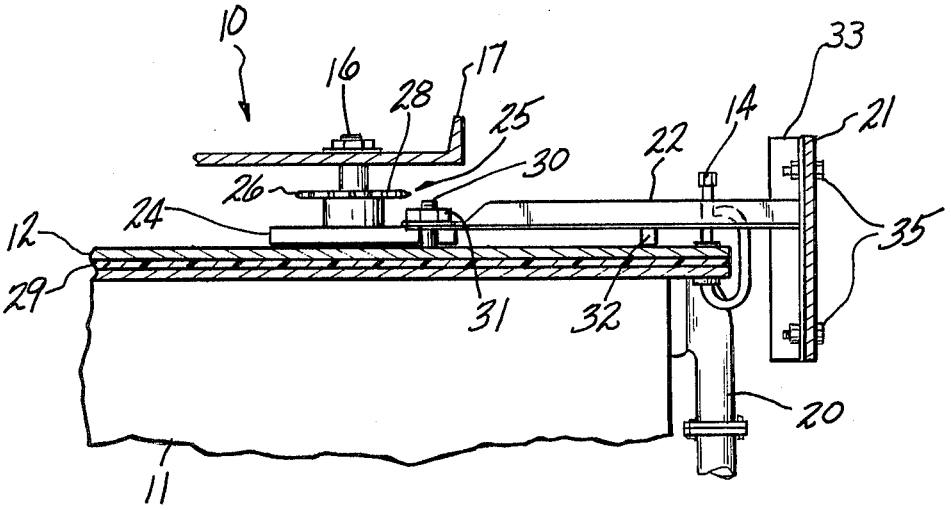
FIG. 3 is a sectional view taken along the line 3—3 of FIG. 2.

Looking now at FIG. 2, the mercury electrolytic chlor-alkali cell 10 is partially shown in top plan view with the protective shield means 21 being fastened by two angle iron brackets instead of three to the cell. A bus bar 17 is seen broken away to show the anode adjusting mechanism 25. As seen in FIG. 3, anode adjusting mechanism 25 comprises a chain 26 mounted about a sprocket 28. The chain 26 and sprocket 28 of the anode adjusting mechanism 25 are appropriately fastened to the drive motor, such as an electric motor (not shown) to automatically adjust the distance between the anodes 15 and the liquid mercury cathode (not shown) in the bottom of container 11.

Also as best seen in FIG. 3, protective shield means 21 are fastened via the angle iron brackets 22 to the electrolyzer cover 12. A threaded bolt 30 and nut 31 fasten each angle iron bracket 22 to the anode seal ring 24. A spacer block 32 is positioned near the edge of the cell and supports each angle iron bracket 22. Each angle iron bracket 22 is preferably fastened to a vertical brace 33, such as by welding. The vertical brace 33 then is fastened to protective shield means 21 such as by bolts and nuts 35.

In operation, the protective shield means 21 is positioned adjacent the edge of the cell 10 where the cover 12 is retained atop the container 11 via the plurality of C-clamps 14. When there is a localized buildup of hydrogen beyond the 1 to 3 percent by volume range within the cell gas, the potential for explosion exists. Should there be a short circuit and the explosive potential be realized, the C-clamps 14 could be blown free and propelled with tremendous force outwardly away from the cell. Protective shield means 21 act as a stop to prevent the C-clamps 14 from flying across the cell room area and also serves to stop any hot brine contained within the cell container 11 from splashing out into the work area where operators may be working.

It should be noted that although the protective shield means 21 is shown only along one side of the cell 10, the protective shield means 21 could equally well be employed along one, two, or all of the sides of the cell 10 during operation.

While the preferred structure in which the principles of the present invention have been incorporated as shown and described above, it is to be understood that the invention is not to be limited to the particular details thus presented, but in fact, widely different means may be employed in the practice of the broader aspects of this invention. The scope of the appended claims is intended to encompass all obvious changes in the details, materials, and arrangement of parts, that will occur to one of skill in the art upon a reading of the disclosure.

What is claimed is:

1. In a chloralkali electrolytic cell for the electrolysis of an aqueous solution of an electrolyte having an electrolyzer container with a plurality of anodes, a liquid mercury cathode flowing along the bottom of the container and an electrolyzer cover separated from the container by a gasket and secured thereto by a plurality of retaining means, the improvement comprising:

shield means of predetermined thickness connected to the electrolyzer container adjacent at least the retaining means and the entire length of at least one side of the cell such that when an explosive buildup of electrolyte cell gas occurs within the electrolyzer container the flight path of the retaining means and any electrolyte expelled from the container is interrupted by the shield means when the retaining means are forced from their positions and the electrolyte is thrown out of the container from the explosive buildup of hydrogen gas within the electrolyte cell gas.

2. The apparatus according to claim 1 wherein the shield means are fastened to the electrolytic cell via at least one bracket.

3. The apparatus according to claim 2 wherein the retaining means are C-clamps.

4. The apparatus according to claim 3 wherein the elongate shield means extend above the electrolyzer cover a first predetermined distance and extend down toward the bottom of the cell a second predetermined distance.

5. The apparatus according to claim 2 wherein each bracket is further fastened to a generally vertical brace that is fastened to the shield means.

* * * * *